US006798982B2

(12) United States Patent
Ryu et al.

(10) Patent No.: US 6,798,982 B2
(45) Date of Patent: Sep. 28, 2004

(54) HAIR DRIER HAVING A PAD FOR GENERATING FAR-INFRARED RAYS AND ANIONS AND METHOD FOR MAKING THE PAD

(75) Inventors: Jae-Young Ryu, Koyang (KR); Su-Hong Park, Bucheon (KR)

(73) Assignee: Unix Electronics Co., Ltd., Inchon (KR)

( * ) Notice: Subject to any disclaimer, the term of this patent is extended or adjusted under 35 U.S.C. 154(b) by 0 days.

(21) Appl. No.: 10/290,336

(22) Filed: Nov. 8, 2002

(65) Prior Publication Data

US 2004/0001707 A1 Jan. 1, 2004

(30) Foreign Application Priority Data

Jun. 29, 2002 (KR) ..... 2002-37411

(51) Int. Cl.[7] ..... A45D 20/10
(52) U.S. Cl. ..... 392/385; 34/97; 428/98
(58) Field of Search ..... 392/384–385, 392/379, 360; 34/96, 97; 219/548, 549, 553, 528; 428/98–99, 137, 148–150, 221, 324; 607/100, 109

(56) References Cited

U.S. PATENT DOCUMENTS 4,680,822 A * 7/1987 Fujino et al. ..... 5/421
6,108,581 A * 8/2000 Jung ..... 607/100
6,205,674 B1 3/2001 Kaizuka
6,378,225 B1 * 4/2002 Slingo ..... 34/97
6,481,116 B1 * 11/2002 Slingo ..... 34/97
2003/0152373 A1 * 8/2003 Wong et al. ..... 392/385

FOREIGN PATENT DOCUMENTS

| | | | |
|---|---|---|---|
| EP | 329864 | * | 8/1989 |
| GB | 2211419 | * | 7/1989 |
| JP | 1-131606 | * | 5/1989 |
| JP | 2-65801 | * | 3/1990 |
| JP | 3-23805 | * | 1/1991 |
| JP | 5-168518 | * | 7/1993 |
| KR | U.M.1996-0010633 | | 12/1996 |
| KR | 2001112154 | * | 12/2001 |

* cited by examiner

*Primary Examiner*—John A Jeffery
(74) *Attorney, Agent, or Firm*—Robert E. Bushnell, Esq.

(57) ABSTRACT

A hair dryer has a pad structure for generating far-infrared rays and anions in which minerals such as muscovite, tourmaline and lanthanum are mixed and bonded to each other by a bonding agent to form a pad structure for surrounding an electrothermal wire. When the electrothermal wire is heated, far-infrared rays and anions can be directly and continuously emitted from the pad regardless of the service period of the hair dryer. The pad can be applied to electrical consumer appliances with the electrothermal wire such as a curling brush, a microwave oven, and a toaster.

25 Claims, 6 Drawing Sheets

HAIR DRIER HAVING A PAD FOR GENERATING FAR-INFRARED RAYS AND ANIONS AND METHOD FOR MAKING THE PAD

CLAIM OF PRIORITY

This application makes reference to, incorporates the same herein, and claims all benefits accruing under 35 U.S.C. § 119 from an application for "HAIR DRIER HAVING A PAD FOR GENERATING FAR-INFRARED RAYS AND ANIONS AND METHOD FOR MAKING THE PAD" earlier filed in the Korean Patent Office on Jun. 29, 2002, and there duly assigned Serial No. 2002-0037411 by that Office.

BACKGROUND OF THE INVENTION

1. Field of the Invention

The present invention relates to a hair drier having a pad structure for generating far-infrared rays and anions, more specifically to a pad structure in which a number of minerals such as muscovite, tourmaline and lanthanum are mixed to form a plate shaped pad structure for surrounding an electrothermal wire, and a method for making the pad structure.

2. Description of the Related Art

A hair drier draws air from the outside of the hair drier, heats the air, and blows the heated air through a front portion of the hair drier to remove remaining moisture from hair for a short time or to set a desired hair style. In the conventional hair drier, the hair-dryer has an electrothermal wire which is heated at a certain temperature when the hair drier is powered by a power supply. As a result, a user can remove remaining moisture from hair for a short time or to make hair in a desired style. However, frequent use of this hair drier tends to damage hair, for example, splitting hair tips.

On this reason, minerals such as tourmaline for generating far-infrared rays or anions is coated with an adhesive on the surface in contact with the electrothermal wire, that is, the surface of at least one of a heat insulating pad surrounding the electrothermal wire and the support plate where the electrothermal wire is wound. Therefore, when the electrothermal wire is heated, minerals coated with an adhesive on the heat-insulating pad or the supporting plate generate far-infrared rays or anions to prevent the detriment of hair. However, because the coating is attached with the adhesive, the heat from the electrothermal wire significantly lowers the adhering force of adhesive. This causes minerals to separate or peel off from the heat-insulating pad or the supporting plate. Therefore, as the hair drier is longer, the generation of far-infrared rays or anions is more reduced.

SUMMARY OF THE INVENTION

It is therefore an object of the present invention to provide an improved hair dryer generating far-infrared rays and anions.

It is another object to provide a pad structure generating far-infrared rays and anions for long.

It is also an object to provide an improved method for making the pad structure.

It is further an object to provide an improved pad structure to prevent the detriment of hair.

In order to achieve the above and other objectives, the preferred embodiment of the hair dryer includes: a body having an inlet and an outlet; an intake cover having a filter, the intake cover connected to the inlet; a nozzle having a grille, the nozzle connected to the outlet; a handgrip connected to the body and the intake cover; a motor mounted within the body for generating current of air through the inlet and the outlet, the motor having a rotation shaft; a fan press-fitted into the rotation shaft, the fan drawing the air from the inlet and blowing the air through the outlet: a plate mounted between the outlet and the motor; an electrothermal wire wound around the plate for heating the drawn air from the inlet; and a pad surrounding the electrothermal wire, the pad comprising minerals and a bonding agent bonding the minerals to each other, the pad being elastic and generating far-infrared rays and anions when the electrothermal wire is heated.

It is preferred that the minerals comprise muscovite with a ratio of about 85 to about 95 percent by weight, tourmaline with a ratio of less than about 10 percent by weight, and lanthanum with a ratio of less than about 0.1 percent by weight. It is more preferred that the tourmaline has a ratio of about 3 to about 5 percent by weight. It is also more preferred that the lanthanum has a ratio of about 0.01 percent by weight.

The pad can be made into various shapes. It is preferred that the pad has a plate shape. The supporting plate can be made of the pad.

The pad according to the present invention can be applied to electrical consumer appliances with the electrothermal wire such as a curling brush, a microwave oven, and a toaster.

A method of making a pad for generating far-infrared rays and anions, the method comprising the steps of: pulverizing muscovite having a high elasticity and dielectricity and tourmaline having pyroelectricity for generating far-infrared rays and anions into fine granules; producing a mixture by mixing the pulverized granules of muscovite, tourmaline, and lanthanum which is able to be charged without any external energy supply to perform ionization; and bonding the granules to each other by adding a bonding agent to the mixture. The method may further include the step of heat-pressing the bonded mixture to form a plate-shaped pad, preferably at a surface temperature of about 400° C. with a pressing roller.

According to the present invention, when the electrothermal wire is heated, far-infrared rays and anions can be directly and continuously emitted from the pad structure regardless of the service period of the hair drier so that hair damaged by curling or dyeing can be recovered, a scalp can be maintained sound, and hair can be maintained in a desired style for a long time.

DETAILED DESCRIPTION OF THE PREFERRED EMBODIMENT

Figure 1:
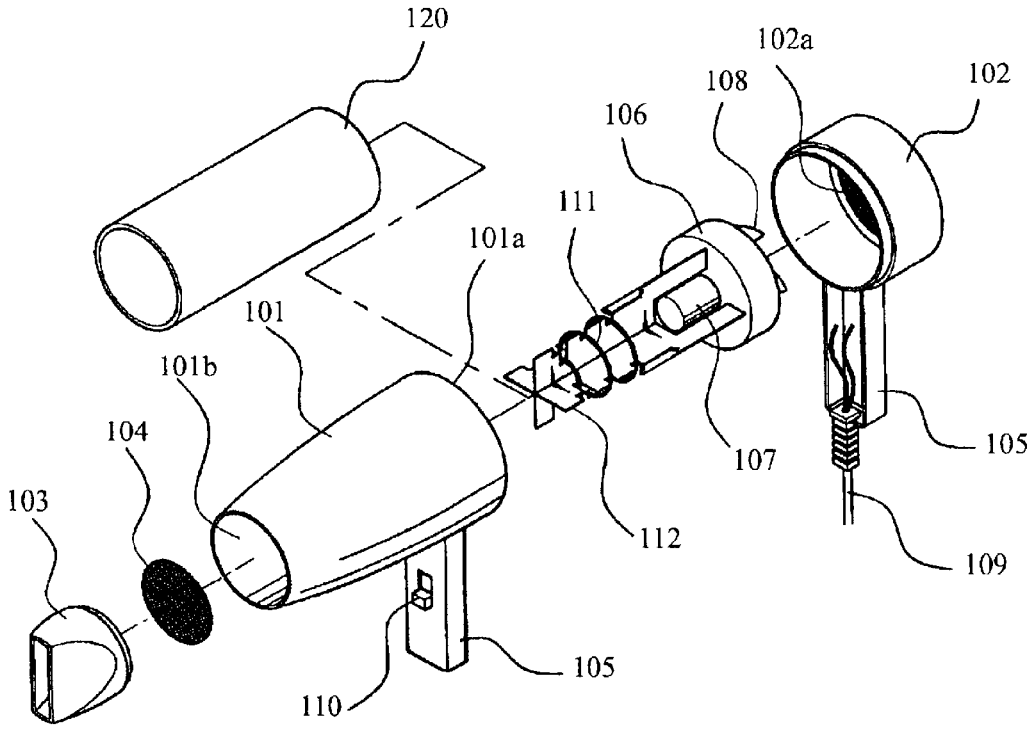
FIG. 1 is an exploded perspective view of a hair drier.
Figure 2:
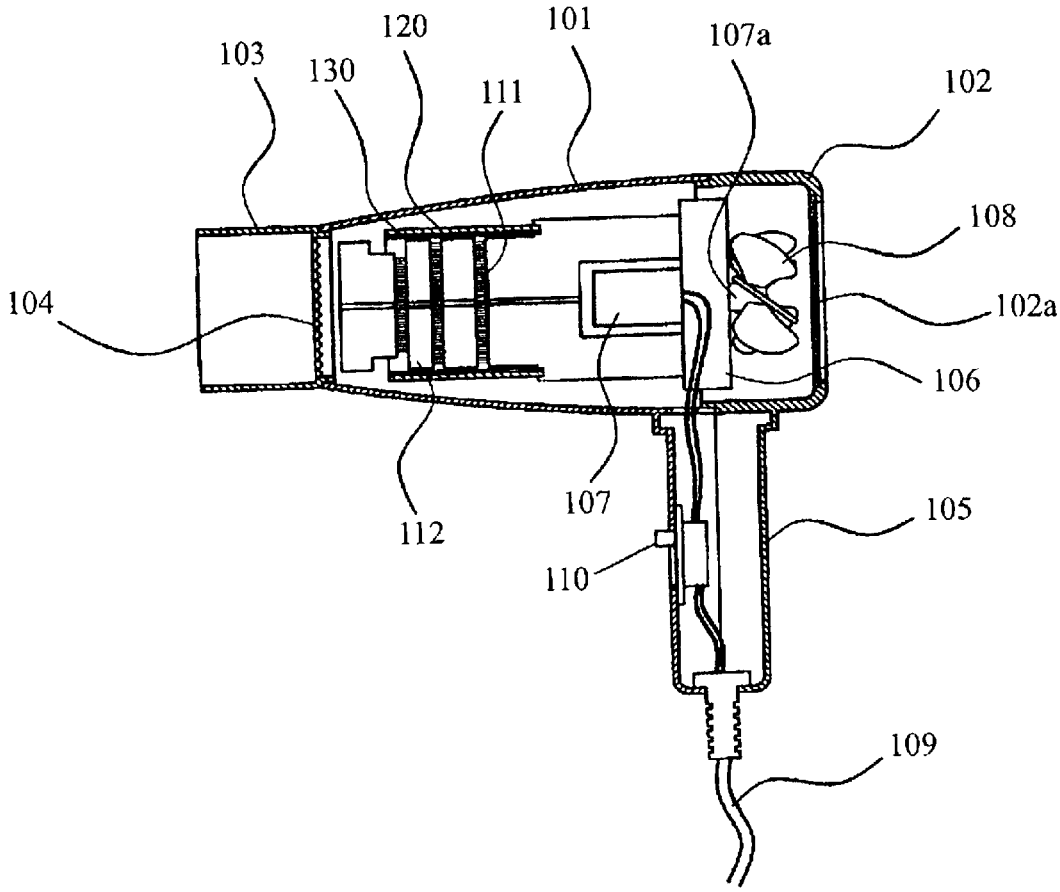
FIG. 2 is a sectional view of a hair drier in which a heat-insulating pad coated with minerals is installed around an electrothermal wire.

The hair drier shown in FIGS. 1 and 2 has a body 101 having an inlet 101*a* for sucking air from the outside of the hair dryer and an outlet 101*b* for discharging the sucked air, an intake cover 102 which has a filter 102*a* and is connected to the inlet 101*a*, a nozzle 103 having an outlet grille 104 connected to the outlet 101*b*, and a handgrip 105 connected to a lower portion of the body 101 and the intake cover 102. A driving motor 107 is internally mounted on a flange 106 for generating current of air through the inlet 101*a* and the outlet 101*b*. A blowing fan 108 is pressure-inserted into a rotation shaft 107*a* of the driving motor 107 for blowing air from the inlet 101*a* to the outlet 101*b*. A power cord 109 is for applying power to the motor 107, and a switch 110 is connected to the power cord 109 for supplying or interrupting the applied power.

An electrothermal wire 111 is wound on a supporting plate 112 between the outlet 101*b* and the motor 107 so as to heat the air sucked through the inlet 101*a*. The electrothermal wire 111 is also surrounded by a heat-insulating pad 120. The heat-insulating pad 120 is intended to prevent heat transfer to the body 101 when the electrothermal wire 111 is heated.

When the switch 110 is pushed which is disposed at the handgrip 105, supply voltage from the power supply is supplied through the power cord 109 to the driving motor 107 and the electrothermal wire 111. Then, the driving motor 107 rotates at a certain rotation speed, while the electrothermal wire 111 is heated and radiates heat.

FIG. 2 shows that minerals 130 such as tourmaline for generating far-infrared rays or anions are coated with an adhesive on the surface in contact with the electrothermal wire 111, that is, the surface of at least one of the heat insulating pad 120 surrounding the electrothermal wire 111 and the support plate 112 wound by the electrothermal wire. Therefore, when the electrothermal wire 111 is heated, the minerals 130 bonded on the heat-insulating pad 120 or the supporting plate 112 generates far-infrared rays or anions to prevent the detriment of hair.

When the minerals are coated on the heat insulating pad 120 or the supporting plate 112 with the adhesive as set forth above, the heat from the electrothermal wire 111 significantly lowers the adhering force of the adhesive. This causes the mineral 130 to separate or peel off from the heat-insulating pad 120 or the supporting plate 112. Therefore, as the hair drier is used longer, the generation of far-infrared rays or anions is more reduced.

Figure 3:
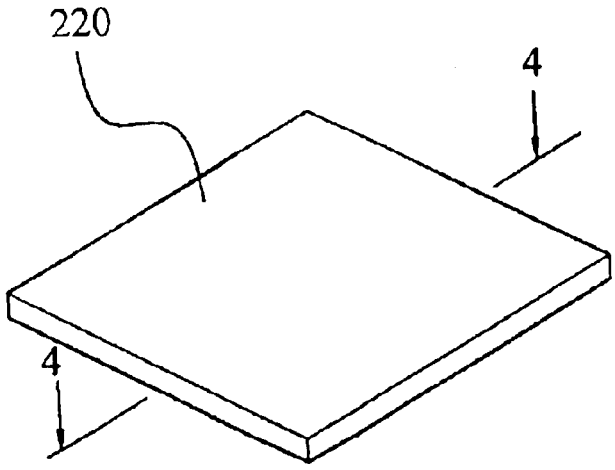
FIG. 3 is a plate-shaped pad structure according to the preferred embodiment of the present invention.
Figure 4:
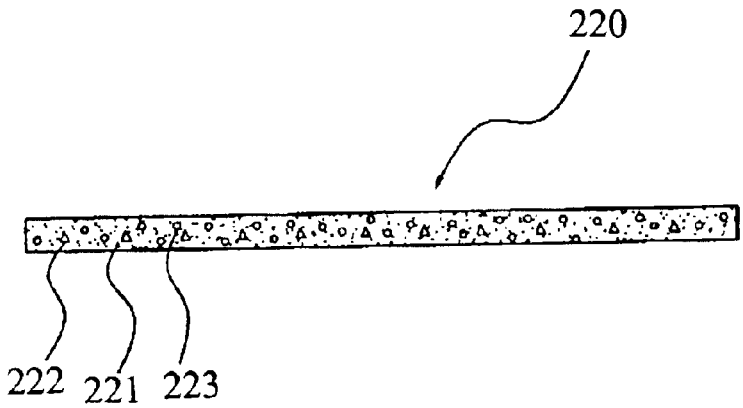
FIG. 4 is a sectional view taken along a line 4—4 in FIG. 3.
Figure 5A:
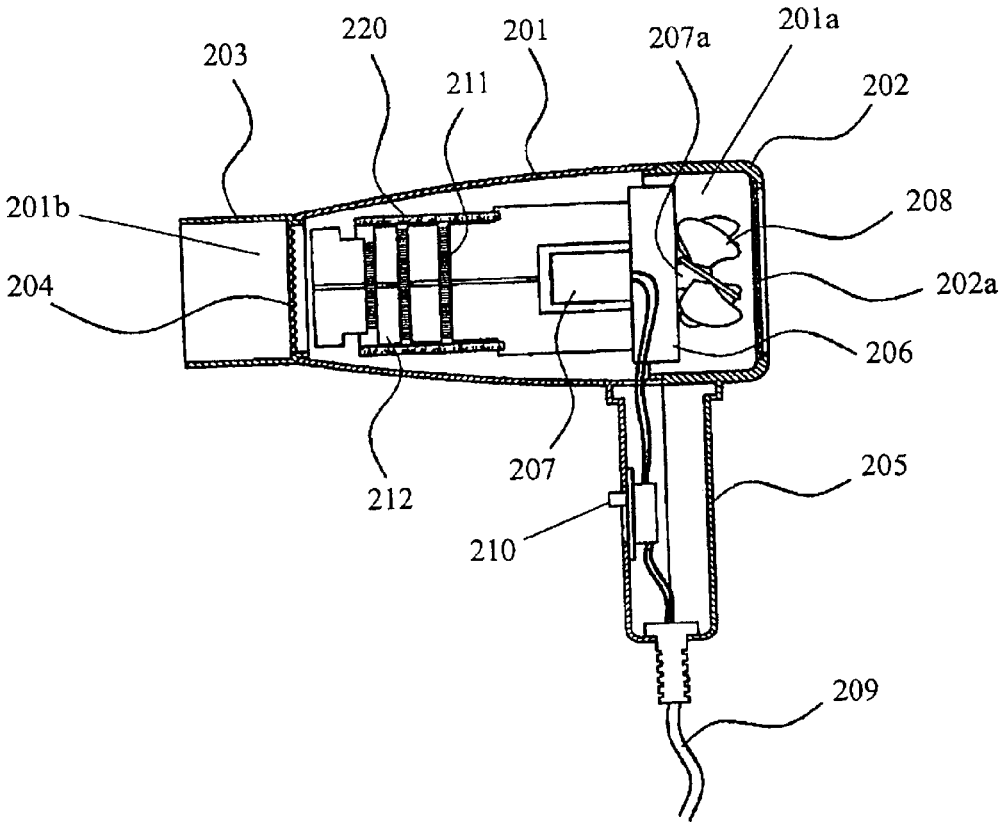
FIG. 5A is a sectional view of a hair drier in which a pad structure for generating far-infrared rays and anions is mounted on an electrothermal wire according to the preferred embodiment of the present invention.
Figure 5B:
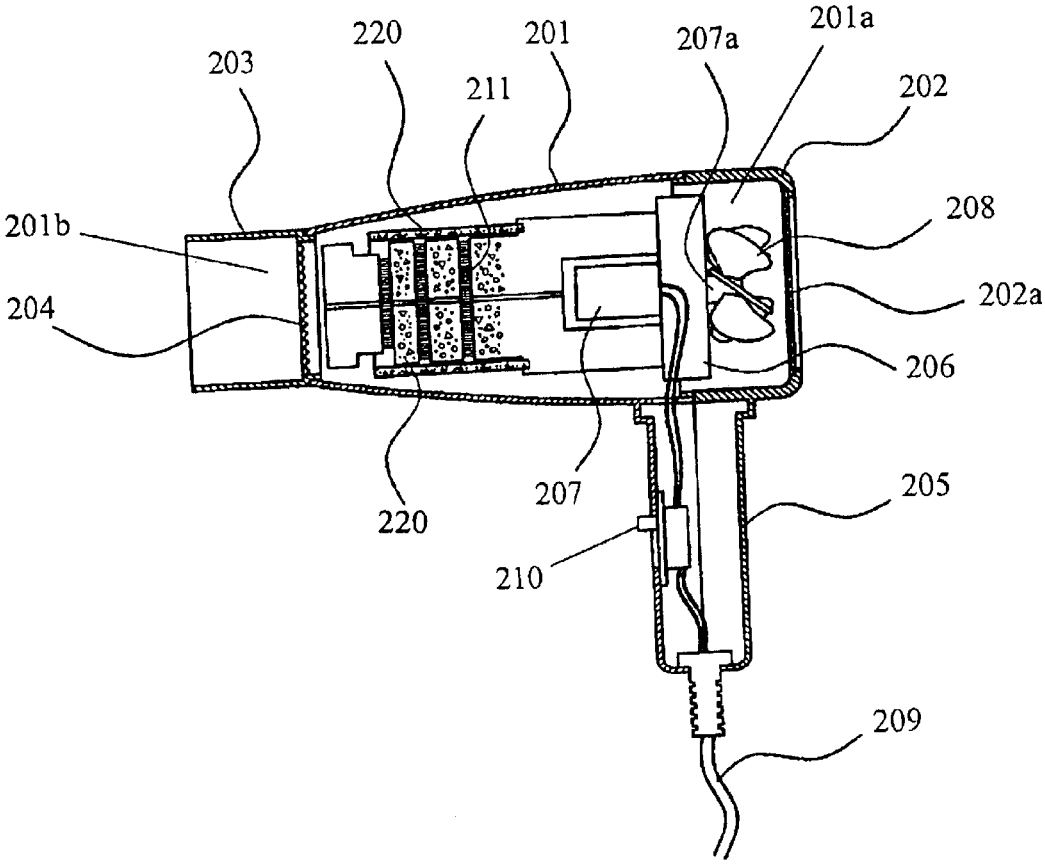
FIG. 5B is a sectional view of a hair drier in which a pad structure for generating far-infrared rays and anions is mounted on an electrothermal wire and on a supporting plate according to another preferred embodiment of the present invention.

FIG. 3 is a plate-shaped pad structure according to a preferred embodiment of the present invention, FIG. 4 is a sectional view taken along a line 4—4 in FIG. 3, and FIG. 5A is a sectional view of a hair drier in which a pad structure for generating far-infrared rays and anions is mounted on an electrothermal wire according to the embodiment of the invention, and FIG. 5B is sectional view of a hair drier in which a pad structure for generating far-infrared rays and anions is mounted on an electrothermal wire and on a supporting plate according to another preferred embodiment of the present invention.

As shown in FIGS. 3 to 5, the hair drier having a pad structure for generating far-infrared rays and anions has a body 201 having an inlet 201*a* for sucking air from the outside and an outlet 201*b* for discharging the sucked air, an intake cover 202 which has a filter 202*a* and is connected to the inlet 201*a*, a nozzle 203 which has an outlet grille 204 and is connected to the outlet 201*b*, a handgrip 205 connected to the lower portion of the body 201 and the intake cover 202, a driving motor 207 mounted on a flange 206 inside the body 201 for generating current of air through the inlet 201*a* and the outlet 201*b*, a blowing fan 208 press-fitted into a rotation shaft 207*a* of the driving motor 207 for blowing out air from the inlet 201*a* to the outlet 201*b*, a power cord 209 for applying power to the driving motor 207, a switch 210 connected to the power cord 209 for supplying or interrupting the power; and an electrothermal wire 211 wound in a spiral shape around a supporting plate 212 between the outlet 201*b* and the driving motor 207 for heating the air sucked from the inlet 201*a*. A pad 220 which is elastic owing to mixed various mineral surrounds the electrothermal wire 211 which is wound around the supporting plate 212 in order to generate far-infrared rays and anions while the electrothermal wire is heated as the hair drier is powered. As shown in FIG. 5B, the pad 220 is preferably formed in a plate shape.

The pad 220 is made of the mixed minerals pulverized in a fine granule size and a bonding agent. The minerals are comprised of muscovite 221, tourmaline 222, and lanthanum 223. It is preferred that the minerals are comprised of about 85 to about 95 weight percent (wt %) of the muscovite 221, less than about 10 wt % of the tourmaline 222, and less than about 0.1 wt % of the lanthanum 223. Alternatively, the supporting plate 212 may be provided as the pad 220 made of mixture of muscovite, tourmaline and lanthanum, and a bonding agent. That is, the pad 220 may be formed as the supporting plate 12 so that the electrothermal wire 11 can be wound around it. Also, the pad 220 may be formed in a cylindrical shape so as to surround the electrothermal wire 11.

A method for making the pad 220 comprises the steps of pulverizing muscovite 221 with a high elasticity and dielectricity and tourmaline 222 with a pyroelectricity generating far-infrared rays and anions in a fine granule; mixing the pulverized granules of muscovite 221 with a ratio between about 85 and about 95 wt %, tourmaline 222 with a ratio of less than about 10 wt % and lanthanum 223 with a ratio of less than about 0.1 wt % charged without any external energy supply to perform ionization, and adding a bonding agent to the mixture of the pulverized granules. Then, according to the desired shape, the pad 220 is processed. For example, if the pad 220 is the shape of a plate, the method further includes the step of pressing the bonded mixture at a surface temperature of about 400° C. using a pressing roller to form a plate-shaped pad.

The operation according to the embodiment of the invention will be described in reference to FIGS. 3 to 5.

First, muscovite having a high elasticity and dielectricity and tourmaline for generating anions and/or far-infrared rays based on a pyroelectricity is pulverized into fine granules.

Then, the pulverized muscovite and tourmaline granules are mixed with lanthanum which is charged without any external energy supply to perform ionization. When muscovite 221, tourmaline 222 and lanthanum 223 in the pad 220 are mixed to have a mixing ratio of 100 wt % after pulverization, muscovite 221 has a ratio between about 85 and about 95 wt %, tourmaline 222 has a ratio of less than about 10 wt %, and lanthanum 223 has a ratio of less than about 0.1 wt %. A bonding agent is added to this mixture of muscovite 221, tourmaline 222 and lanthanum 223. As a result of this mixing process, the mixture of muscovite 221, tourmaline 222 and lanthanum 223 has a strong bonding force to one another owing to the added bonding agent.

It is more preferred that tourmaline 222 has a mixing ratio of about 3 to 5 wt % but is not restricted thereto. It is more preferred that lanthanum 223 has a mixing ratio of about 0.01 wt %, but is not restricted thereto.

The mixture bonded firmly by the bonding agent is pressed by a press roller with a surface temperature of about 400° C. if a plate-shaped pad 220 as shown in FIG. 3 is desired.

Then, the plate-shaped pad 220 obtained as above is cut with a certain width and length to form a cylindrical shape. This cylindrical pad 220 is mounted to surround the electrothermal wire 211 wound around the supporting plate 212 in the hair drier.

In the hair drier with the pad 220 according to the preferred embodiment of the present invention, when the switch 210 in the front of the grip 205 is turned on, the driving motor 207 and the electrothermal wire 211 are powered from the power supply (not shown) via the power cord 209. This makes the motor 207 rotate at a given rotation speed, and simultaneously the electrothermal wire 211 is heated at a given temperature.

The blowing fan 208 draws the air from the outside of the hair drier through the filter 202*a* of the intake cover 202. The sucked air by the blowing fan 208 is heated while flowing through the inlet 201*a* of the body 201 and the electrothermal wire 211 wound around the supporting plate 212, and then is blown toward the outlet 201*b* of the body 201. The hot air blown toward the outlet 201*b* is exhausted to the outside via a nozzle 203 and the outlet grille 204 both of which are connected to the outlet 201*b* of the body 201. The exhausted hot air allows the user to remove remaining moisture from his or her hair for a short time or to set his or her hair into a desired shape.

While the electrothermal wire 211 is heated which is surrounded by the cylindrical pad 220, the muscovite component 221 in the pad 220 functions to prevent heat transfer from the electrothermal wire 211 to the body 201, the tourmaline component 222 in the pad 220 functions to generate anions and far-infrared rays, and the lanthanum component 223 in the pad 220 evokes charge to perform ionization without any external energy supply.

As hot or cold wind flows through the nozzle 203 of the hair drier toward hair together with far-infrared rays and anions generated from the pad 220, far-infrared rays and anions allow the user of the hair drier to protect hair or scalp. Alternatively, the pad may be designed to have a reel shape as the supporting plate 212, even if it has not been illustrated. Therefore, the electrothermal wire 211 may be disposed inside the pad in the cylindrical shape, and simultaneously outside the pad in the reel shape.

According to the invention as set forth above, the pad can be used in the cylindrical shape and the reel shape simultaneously. Alternatively, the pad can be used only in the reel shape like the supporting plate 212. Furthermore, the pad may be found in various applications if necessary. For example, the pad generating far-infrared rays and anions according to the present invention can be applied to electrical consumer appliances with the electrothermal wire such as a curling brush, a microwave oven, and a toaster. Therefore, the design of the pad may be changed depending on the property of appliances.

As described above, according to the hair drier having a pad for generating far-infrared rays and anions and the method for making the pad according to the present invention, far-infrared rays and anions are emitted directly and continuously from the pad regardless of the service period of the hair drier when the electrothermal wire is heated. The electrothermal wire is obtained from mixture of a number of minerals such as muscovite, tourmaline, and lanthanum, which is formed into the plate-shaped pad. The pad surrounds the electrothermal wire so that hair and scalp damaged by curling and dyeing can be reinvigorated and hair can be maintained in a desired style for a long time.

While this invention has been shown and described in connection with the preferred embodiment for illustrating the principle of the present invention, it is to be understood to those skilled in the art that the present invention is not limited to the preferred embodiment and it is possible to do various modifications and variations to the present invention without departing the spirit and scope of the appended claims. Therefore, those appropriate modifications and variations and equivalents should be considered to be within the scope of the present invention.

What is claimed is:

1. A hair dryer generating far-infrared rays and anions, said hair dryer comprising:

a body having an inlet and an outlet;

an intake cover having a filter, said intake cover connected to said inlet;

a nozzle connected to said outlet;

a handgrip connected to said body and the intake cover;

a motor mounted within said body for generating current of air through said inlet and said outlet, said motor having a rotation shaft;

a fan coupled to said rotation shaft, said fan drawing said air from said inlet and blowing said air through said outlet;

a plate mounted between said outlet and said motor, an electrothermal wire wound around said plate for heating the drawn air from said inlet; and a first pad surrounding said electrothermal wire, said first pad comprising first minerals and a bonding agent bonding said first minerals to each other, said first pad being elastic, heat-insulating said body of the hair dryer from said electrothermal wire, and generating far-infrared rays and anions when said electrothermal wire is heated.

2. The hair dryer of claim 1, with said first pad having a cylindrical shape.

3. The hair dryer of claim 1, wherein said first minerals comprise muscovite, tourmaline, and lanthanum.

4. The hair dryer of claim 1, wherein said first minerals comprise about 85 to about 95 percent by weight of muscovite, less than about 10 percent by weight of tourmaline, and less than about 0.1 percent by weight of lanthanum.

5. The hair dryer of claim 4, wherein said tourmaline has a ratio of about 3 to about 5 percent by weight.

6. The hair dryer of claim 4, wherein said lanthanum has a ratio of about 0.01 percent by weight.

7. The hair dryer of claim 1, with said plate comprising second pad, said second pad comprising second minerals bonded to each other by a bonding agent, whereby said plate generates far-infrared rays and anions when the electrothermal wire is heated.

8. The hair dryer of claim 7, wherein said second minerals comprise muscovite, tourmaline, and lanthanum.

9. The hair dryer of claim 7, wherein said second minerals comprise muscovite with a ratio of about 85 to about 95 percent by weight, tourmaline with a ratio of less than about 10 percent by weight, and lanthanum with a ratio of less than about 0.1 percent by weight.

10. The hair dryer of claim 9, wherein first minerals comprise about 85 to about 95 percent by weight of muscovite, about 10 percent by weight of tourmaline, and less than about 0.1 percent by weight of lanthanum.

11. A pad for generating far-infrared rays and anions, said pad comprising:

minerals comprising muscovite, tourmaline, and lanthanum; and a bonding agent bonding said minerals to one another, said pad being elastic, said pad generating far-infrared rays and anions when heated.

12. The pad of claim 11, wherein said mixture comprises about 85 to about 95 percent by weight of said muscovite, less than about 10 percent by weight of said tourmaline, and less than about 0.1 percent by weight of said lanthanum.

13. The pad of claim 12, wherein a content of said tourmaline is in the range of about 3 to about 5 percent by weight.

14. The hairdryer pad of claim 12, wherein a content of said lanthanum is about 0.01 percent by weight.

15. A hair dryer comprising the pad of claim 11.

16. A hair dryer, comprising:

a body disposed to conduct passage of ambient air between an inlet and a nozzle;

a fan positioned to blow the air through said nozzle;

a plate within the passage of the ambient air;

an electrothermal wire wound around said plate; and a first pad surrounding said electrothermal wire, said first pad comprising first minerals and a bonding agent bonding said first minerals to each other, said first pad being elastic and thermally insulating said body from said electrothermal wire, and generating far-infrared rays and anions when an electrical current flows through said electrothermal wire.

17. The hair dryer of claim 16, wherein said first minerals comprise muscovite, tourmaline, and lanthanum.

18. The hair dryer of claim 16, wherein said first minerals comprise about 85 to about 95 percent by weight of muscovite, less than about 10 percent by weight of tourmaline, and less than about 0.1 percent by weight of lanthanum.

19. The hair dryer of claim 16, wherein said plate comprises a second pad, said second pad comprising second minerals bonded to each other by a bonding agent, whereby said plate generates far-infrared rays and anions when the electrothermal wire is heated.

20. The hair dryer of claim 19, said second minerals comprise muscovite, tourmaline, and lanthanum.

21. The hair dryer of claim 19, wherein at least one of said first minerals and said second minerals comprise muscovite with a ratio of about 85 to about 95 percent by weight, tourmaline with a ratio of less than about 10 percent by weight, and lanthanum with a ratio of less than about 0.1 percent by weight.

22. A hair dryer, comprising:

a body disposed to conduct a passage of ambient air between an inlet and a nozzle;

a fan positioned to blow the air through said nozzle;

a plate mounted within the passage of the air;

an electrothermal wire wound around said plate; and a first pad surrounding said electrothermal wire, said first pad comprising muscovite, tourmaline, and lanthanum and a bonding agent bonding said muscovite, said tourmaline, and said lanthanum together, said first pad generating far-infrared rays and anions when an electrical current flows through said electrothermal wire.

23. The hair dryer of claim 22, wherein a content of said muscovite is about 85 to about 95 percent by weight, a content of said tourmaline is less than about 10 percent by weight, and a content of said lanthanum is less than about 0.1 percent by weight.

24. The hair dryer of claim 22, wherein said plate comprises a second pad, said second pad comprising muscovite, tourmaline, and lanthanum bonded to each other by a bonding agent, and said plate generates far-infrared rays and anions when the electrothermal wire is heated.

25. The hair dryer of claim 24, wherein a content of said muscovite in said plate is about 85 to about 95 percent by weight, a content of said tourmaline in said plate is less than about 10 percent by weight, and a content of said lanthanum in said plate is less than about 0.1 percent by weight.

* * * * *